US005328426A

United States Patent [19]

Vendette

[11] Patent Number: 5,328,426

[45] Date of Patent: Jul. 12, 1994

[54] LEG STRETCHER

[76] Inventor: Keith Vendette, 147 Jessica Dr., East Hartford, Conn. 06118

[21] Appl. No.: 932,751

[22] Filed: Aug. 20, 1992

[51] Int. Cl.[5] ..... A63B 21/02

[52] U.S. Cl. ..... 482/91; 482/907; 482/39

[58] Field of Search ..... 482/907, 44, 79, 93, 482/95-96, 905, 907, 127, 83, 91; 128/25 A, 25 B, 25 R

[56] References Cited

U.S. PATENT DOCUMENTS 2,058,563 10/1936 Cambell ..... 128/25 R
3,013,799 12/1961 Wise ..... 482/118
4,615,335 10/1986 Searcy ..... 482/904
4,628,910 12/1986 Krokowski ..... 128/25 R

FOREIGN PATENT DOCUMENTS 0671593 4/1968 Belgium ..... 128/25 R

*Primary Examiner*—Richard J. Apley
*Assistant Examiner*—Jerome W. Donnelly
*Attorney, Agent, or Firm*—McCormick, Paulding & Huber

[57] ABSTRACT

A wall mounted leg exercise device has a beam pivoted intermediate its ends to a hub assembly that is vertically adjustable on the wall. One end of the beam has an ankle retaining cuff for the user's leg. The other end opposite said one end relative the pivot axis of the hub carries a hand grip so the user can steady himself as he performs at least three leg exercising kicks.

4 Claims, 5 Drawing Sheets

FRONT KICK

SIDE KICK

BACK KICK

LEG STRETCHER

This invention relates generally to apparatus for use in connection with stretching exercises for one's leg. More particularly, this invention relates to a device adapted to be adjustably mounted on a wall or the like in such a manner that the person utilizing the device can stand with one leg resting on the floor and move the other leg in a generally vertical plane while controlling both his own balance and movement of the leg with one or both hands.

BACKGROUND OF THE INVENTION

Prior art stretching devices for stretching and/or strengthening leg muscles have taken several forms, one of which forms requires that the user be seated and/or located in a prone position so that his legs move in a horizontal plane as taught for example in prior art U.S. Pat. No. 4,456,247 and 4,877,239.

U.S. Pat. No. 4,892,304 does suggest that the user assume an erect position, however one leg is secured against movement and although the other leg is moved in a vertical plane the leg is not kept straight in a kicking motion. The device of this patent immobilizes the user's torso and other leg. Such a situation results in a restrictive motion for the movable leg which does not resemble the kicking motion common to the martial arts.

SUMMARY OF THE INVENTION

According to the present invention I have provided an elongated telescopically adjusted beam, one end of which beam carries an ankle retaining cuff. The beam is pivotably supported at a point intermediate its length for arcuate movement of said cuff in a vertical plane. At least one hand grip is provided on the beam at a point spaced from the pivot axis, and preferably on the opposite side of the axis from the one end portion carrying the cuff.

It is a feature of my invention that the user's other leg rest on the floor without being restricted by supporting devices, and the means pivotably supporting the beam preferably includes a hub adjustably mounted to a preexisting wall structure in order to accommodate users of various leg lengths. Thus, an important feature of the present invention is that the torso of the user not be supported in any way, the user being free to flex his unexercised leg in such a manner as to counteract the reaction force imposed upon his torso as a result of the swinging motion imparted to the pivotal beam by the leg being exercised.

DETAILED DESCRIPTION

Figure 1:
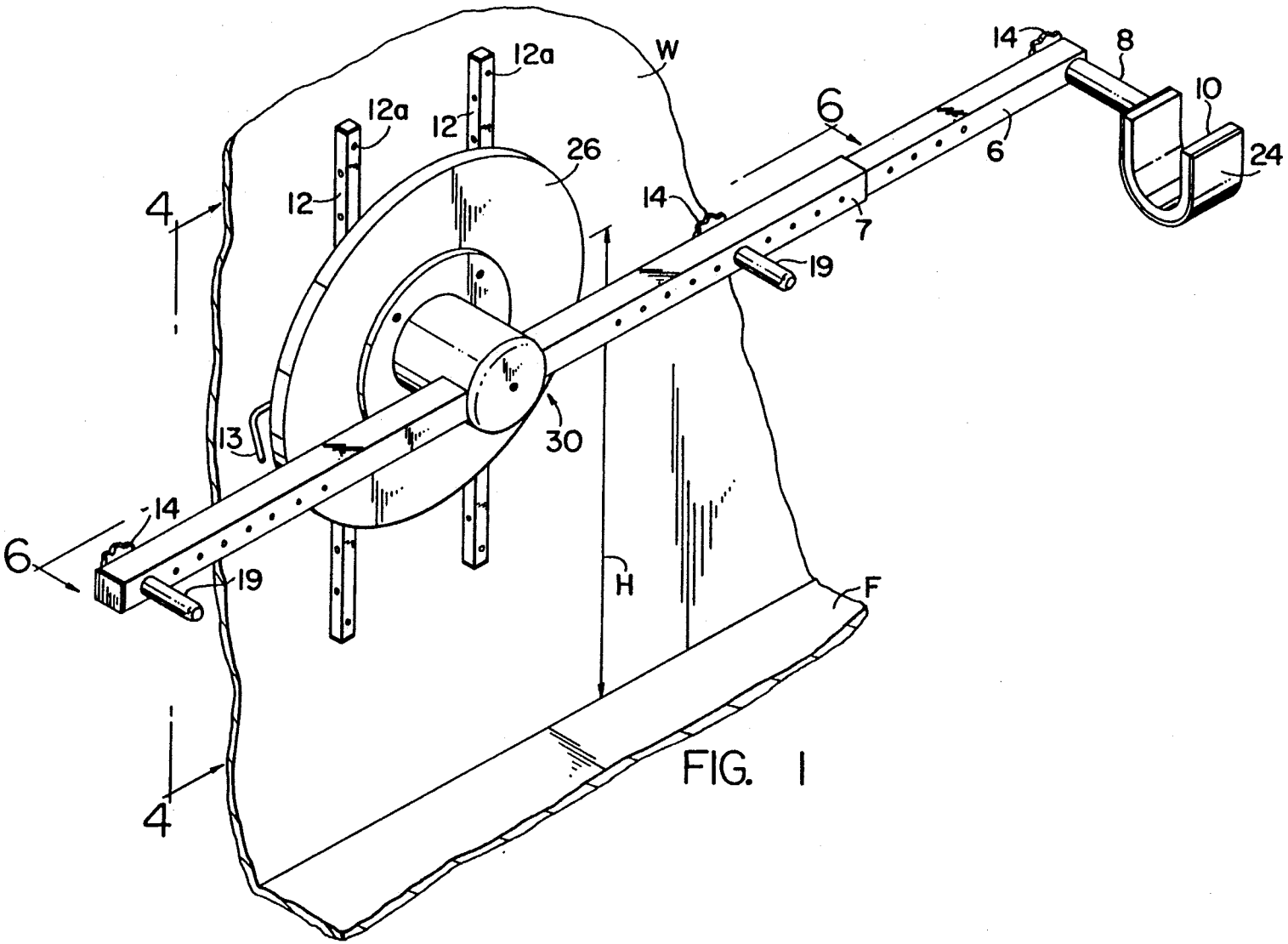
FIG. 1 is a perspective view of an apparatus incorporating the present invention, and as shown the apparatus is mounted on a preexisting wall structure at a height that is adjustable above the floor.

Turning now to the drawings in greater detail, FIG. 1 illustrates the assembled apparatus mounted on a wall W at a height H above the floor F which height is adjustable. A pin 13 is slidably received in openings **12*a* provided for this purpose in each of two upright stanchions 12, 12**. The stanchions are secured to the wall W.

Figure 2:
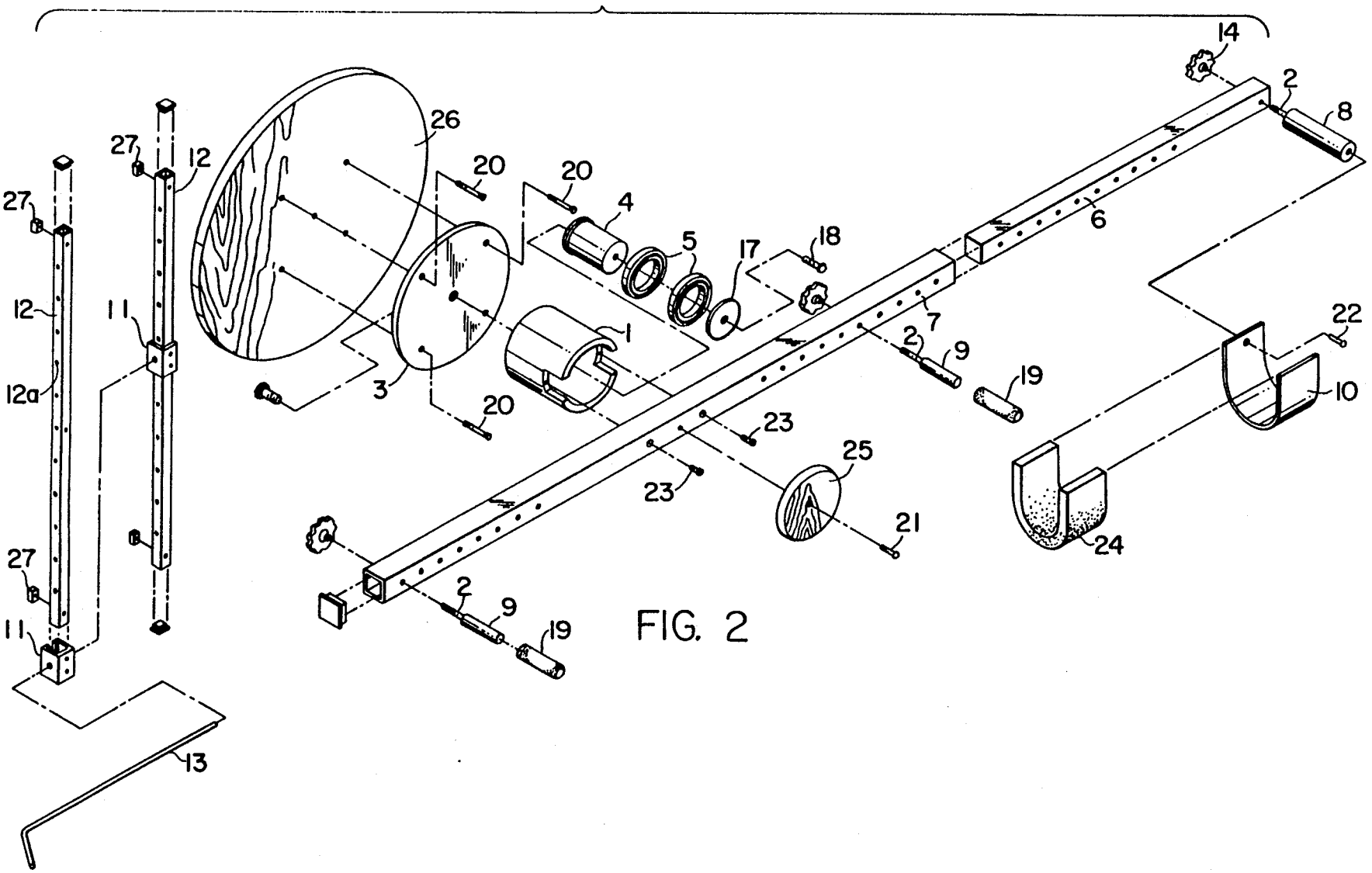
FIG. 2 is an exploded view illustrating the various components of the apparatus depicted in FIG. 1.
Figure 4:
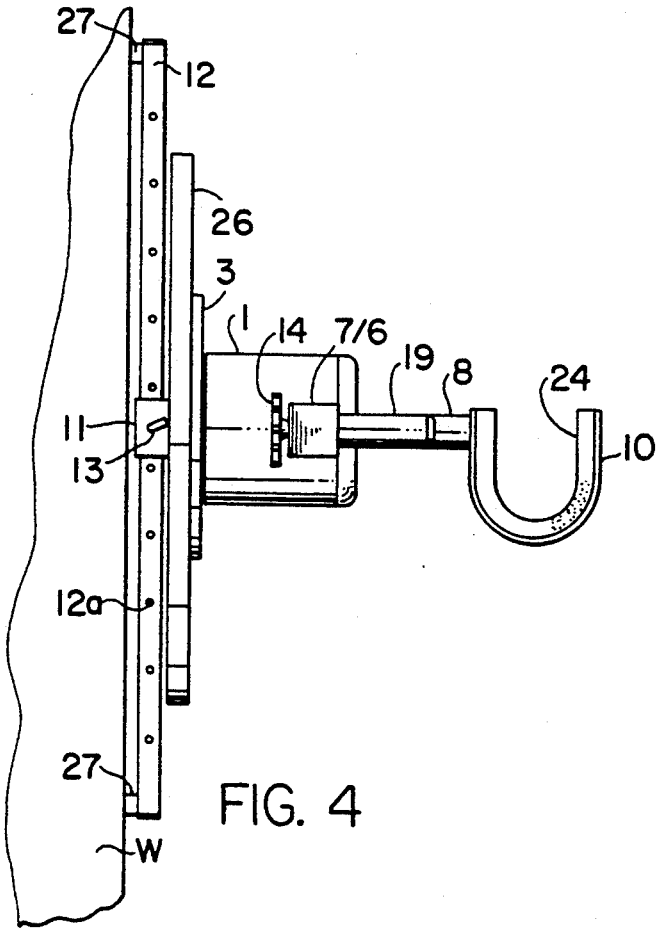
FIG. 4 is a side elevational view of the apparatus shown in FIG. 1 being taken generally on the line 4—4 of that view.

A circular disk 26 has channel shaped slide blocks 11, 11 (not shown in FIG. 1) mounted to its rear face for adjustably mounting the device on the wall. The slide blocks 11, 11 are illustrated in FIGS. 2 and 4. These channel shaped slide blocks are secured to the backside of the circular disk 26 so that removal and reinsertion of the pin 13 permits vertical adjustment of the apparatus relative to the floor F in order to accommodate persons of different height.

Still with reference to FIG. 1, a hub assembly indicated generally at 30 is provided on the front face of the circular disk 26 to define a horizontally extending pivot axis for achieving the angular motion of a beam assembly 7. The beam assembly is oriented generally horizontally in FIG. 1, but can be pivoted from the position shown in FIG. 1 through a range of angular travel both clockwise and counterclockwise from the position shown for it in FIG. 1, and as suggested generally by the view of FIG. 5.

Referring now more specifically to FIG. 2, the various component parts of the apparatus are there shown in exploded relationship to one another. The above mentioned stanchions 12, 12 are adapted to be secured to the wall W and spacer blocks 27, 27 are provided behind the stanchions to permit the channel shaped slide blocks 11, 11 to move vertically and to achieve the above mentioned adjusting feature. The stanchions are secured to the wall with spacers therebetween. As mentioned previously, these channel shaped slide blocks 11, 11 are secured to the backside of the disk 26 by screws (not shown) and as so constructed and arranged the disk 26 can be adjusted vertically relative to the stanchions 12, 12 and can be locked in a range of possible positions as determined by the spacing between the openings **12*a*, 12*a*** in the stanchions.

Figure 6:
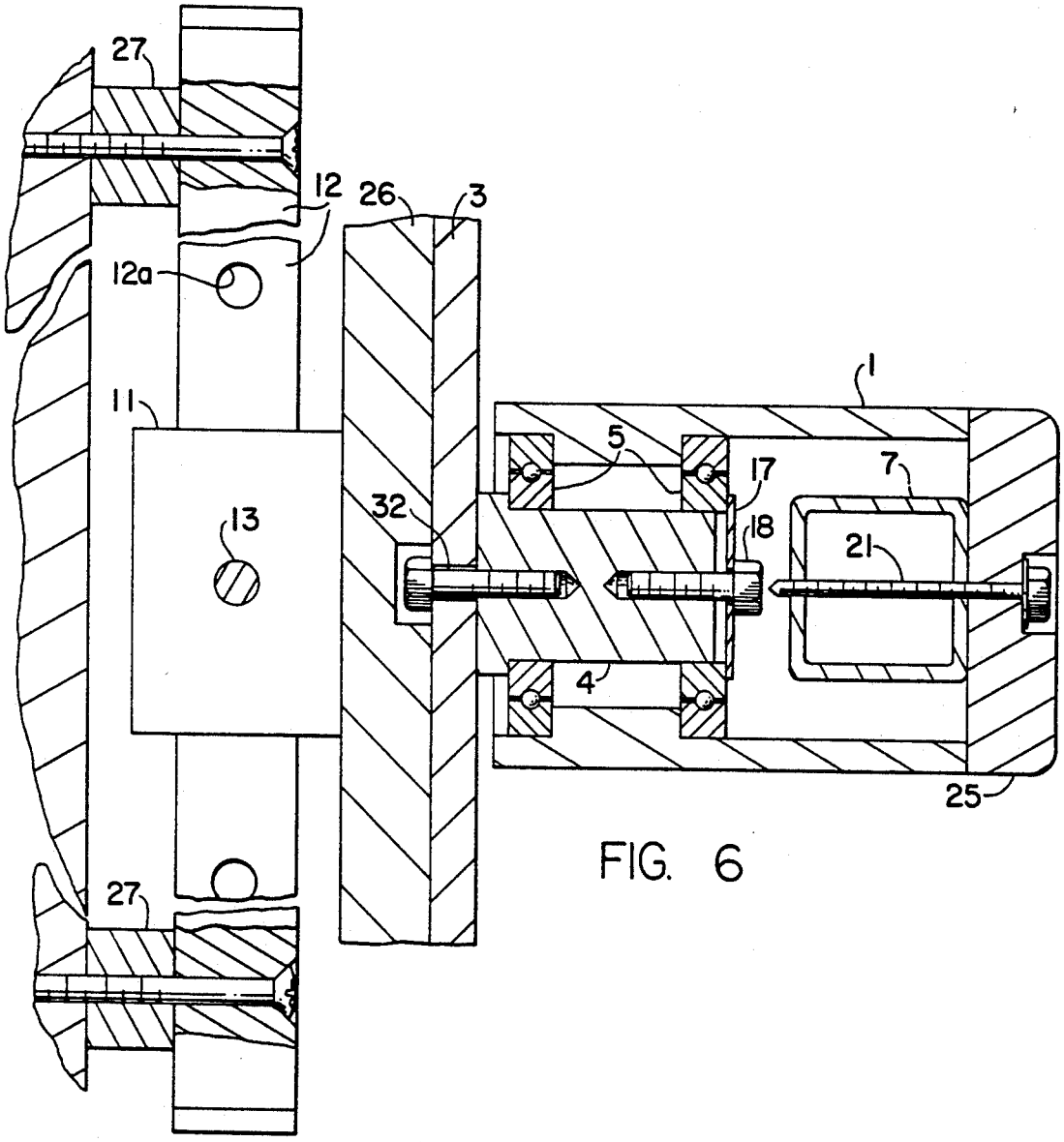
FIG. 6 is a horizontal section taken generally on the line 6—6 of FIG. 1.

A circular plate 3 is secured to the front side of the disk 26 by four attachment screws 20, 20 and a central opening in the circular plate 3 is provided to receive a machine screw 32 which projects through the front face of the plate 3 and threadably receives hub 4. Hub 4 is thus fixedly secured to the plate 3 which is in turn fixedly secured to the disk 26. As so constructed and arranged a convenient surface is provided for receiving the inner race of a pair of conventional roller bearings 5, 5 which roller bearings in turn have outer races that are adapted to receive a rotatable tubular spindle 1. The spindle defines a notch-like recess for receiving the tubular cross beam 7. A retaining ring 17 is provided for securing these components in assembled relationship as best shown in FIG. 6. The cross beam 7 is preferably fabricated from a hollow aluminum tube of square cross section, which tube is secured to the rotatable spindle 1 by screws 23, 23. A decorative face plate 25 may be secured to the cross beam by means of the assembly screw 21 in order to provide a more pleasing appearance for the apparatus.

The cross beam assembly not only includes a rectangular tube 7 but also includes a telescopic section 6 that provides a convenient means for adjusting the length of the cross beam assembly in order to accommodate persons of various size. Two handles 9, 9 are provided at convenient locations on the cross beam with one handle 9 being provided opposite an ankle or foot retaining cuff 10, and the other handle 9 being secured to the cross beam 7 at a location intermediate the pivot axis for the cross beam and the ankle or foot retaining cuff. Thus, the beam 7 is pivotally connected to the rotatable spindle 1 at a point approximating its midpoint so that the cross beam 7 can be manipulated by one or both of the handles 9, 9 as the user either faces the wall or assumes some other position as suggested generally in FIG. 3 for purposes of accomplishing exercises of various types with the apparatus disclosed herein.

The ankle or foot retaining cuff comprises a U-shaped clip 10 which is fitted with a foam rubber pad of the same contour in order to accommodate the ankle of the user. A spacer 8 is provided with a screw 2 at one end which provides for convenient mounting of the ankle or foot retaining device at the free end portion of the telescoping member 6. A hand operated nut 14 is provided to secure the ankle retaining device at this location. Screw 22 is received in one leg of the U-shaped clip 10 and in the end of the spacer 8 opposite the screw end 2 for this purpose.

Means is provided for securing the telescoping end portion 6 to the cross beam 7, and while any sort of clamp screw might be provided for this purpose the preferred version shown has a second handle 9 that is located between the pivot axis and the free end portion of the telescoping beam. A threaded portion 2 of the second handle is adapted to be received in aligned openings of the cross beam and of the telescoping member for this purpose. A hand operated nut 14 may be provided as shown in FIG. 1 to secure the handle in place and to secure the telescoping portion 6 at the desired distance from the pivot axis defined by the hub assembly 30.

Figure 3A:
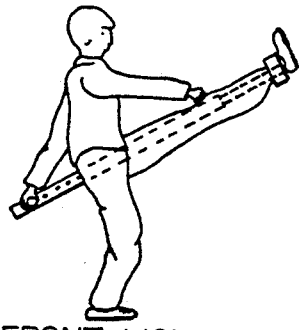
FIGS. 3A, 3B and 3C is a series of views schematically illustrating three different modes of operation for the device by a user.
Figure 3B:
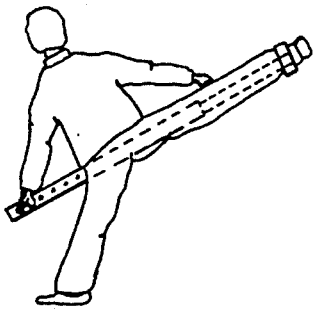
Figure 3C:
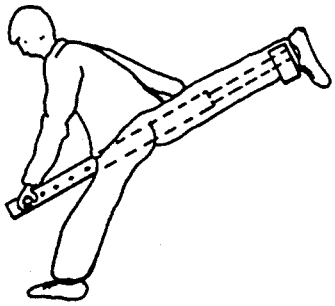

Turning next to FIGS. 3A, 3B and 3C, a user is shown in these views operating the device of FIGS. 1 and 2 in order to perform a variety of kick exercises. In the "front kick" position of FIG. 3A the user puts his left hand on the handle 9 provided adjacent that end portion of the cross beam which is remote from the ankle of foot supporting end, and places his left hip in this case against the hub assembly 30 so that the left leg can be rested in the ankle or foot support saddle 10 and his right arm either free for movement independent of the cross beam or utilized to grip the second handle which is provided between the pivot axis of the hub assembly and the ankle or foot support saddle 10. In this position the user can exercise his left leg in a motion similar to that used in kicking a ball. In the second view FIG. 3B the "side kick" is demonstrated where the user again grips the endmost handle in the left hand and with his backside to the wall, and with his right leg in the saddle 10, kicks to the side with the right hand either on the second handle or allowed to move freely independently of the exercise apparatus itself. Finally, FIG. 3C shows a back kick configuration where the user's right leg is placed in the saddle and the right hip against the wall with the left hand on the endmost handle of the cross beam. In this FIG. 3C position the user can kick backward.

FIG. 4 is a vertical section taken generally on the line 4—4 of FIG. 1 and illustrates the various components of the present invention in a mounted relationship relative to a wall W. The cross beam assembly 7/6 is shown in a horizontal position parallel to the floor all in agreement with the particular position depicted in FIG. 1.

Figure 5:
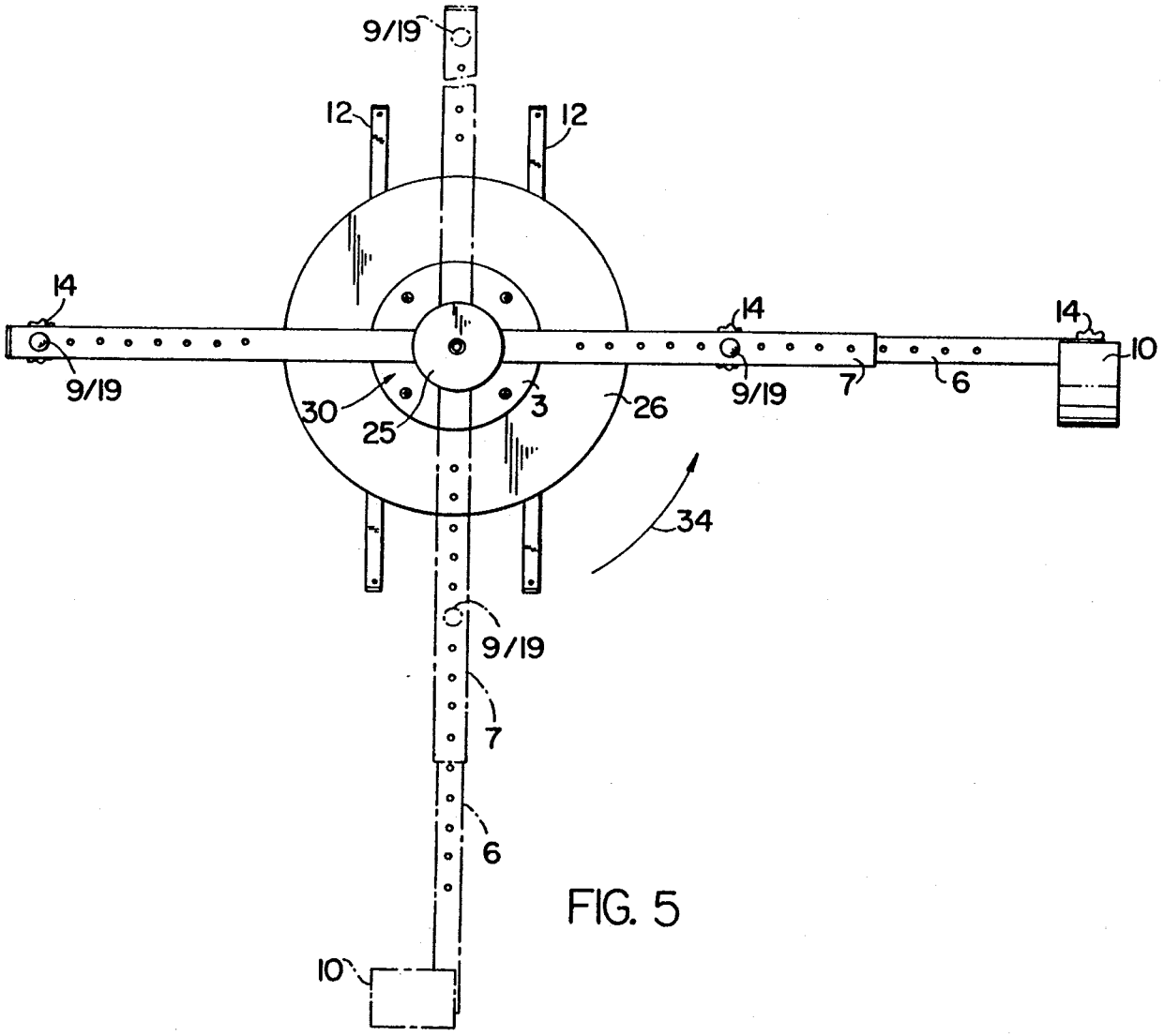
FIG. 5 is a front elevational view of the apparatus depicted in FIG. 1 with the beam being illustrated in two angular positions that illustrate a 90 degree range of angular motion for the beam.

Finally, FIG. 5 shows the apparatus of the present invention with the cross beam assembly 7/6 in two positions angularly spaced from one another by approximately 90 degrees. This view shows the motion of the apparatus as suggested generally by the arrow 34. Actually, the range of motion is not limited to 90 degrees and any desired angular travel can be achieved by the apparatus, limited only by the flexibility of the user's leg in this regard.

FIG. 6 shows the apparatus of the present invention when viewed along the lines 6—6 of FIG. 1 and illustrates in some detail the hub assembly configuration.

I claim:

1. A device for stretching one's leg, said device comprising an elongated beam, an ankle retaining cuff adjacent one end of said beam, means pivotably supporting said beam for arcuate movement of said cuff in a vertical plane, at least one hand grip on said beam, said means pivotably supporting said beam including a hub assembly adjustably mounting said hub assembly to a wall adapted for providing a range of heights in order to accommodate users of various leg lengths, said beam having a second end opposite said one end, said second end provided opposite said one end relative said pivot axis, said at least one hand grip being provided on said second end and a means provided on said elongated beam between said hub assembly and said one end, for accepting a second hand grip.

2. The device according to claim 1 wherein said beam has a length that is adjustable at least between the pivot axis defined by said hub assembly and said one end.

3. The combination according to claim 1 wherein said beam has a length that is adjustable at least between said pivot axis and said one end.

4. The combination according to claim 3 wherein a second hand grip is provided intermediate said pivot axis and said one end of said adjustable length beam.

* * * * *